United States Patent [19]

Ullman, Jr.

[11] 4,096,655

[45] Jun. 27, 1978

[54] FABRIC IDENTIFICATION TAG

[76] Inventor: Myron E. Ullman, Jr., 120 Sleepy Hollow, Canfield, Ohio 44406

[21] Appl. No.: 761,953

[22] Filed: Jan. 24, 1977

[51] Int. Cl.[2] ..... A44C 3/00

[52] U.S. Cl. ..... 40/2 R; 40/23 A; 40/20 R

[58] Field of Search ..... 40/11, 20 R, 23, 23 A, 40/2 R

[56] References Cited

U.S. PATENT DOCUMENTS

| | | | |
|---|---|---|---|
| 2,034,659 | 3/1936 | Laencher | 40/20 R |
| 2,938,252 | 5/1960 | Scheemaeker | 40/23 A X |
| 3,939,585 | 2/1976 | Kahn | 40/23 A |

FOREIGN PATENT DOCUMENTS

| | | | |
|---|---|---|---|
| 878,954 | 11/1942 | France | 40/20 R |
| 1,183,595 | 1/1959 | France | 40/23 A |

*Primary Examiner*—Louis G. Mancene

*Assistant Examiner*—Wenceslao J. Contreras

*Attorney, Agent, or Firm*—Meyer, Tilberry & Body

[57] ABSTRACT

A device is provided to assist not only persons having normal color perception, but also the blind and the color blind for sorting fabrics, especially pairs of articles, such as socks.

This device is also contemplated for use in distinguishing different characteristics of fabrics such as weave, texture, dye run or lot and the like. The device is comprised of a tab connected by hinge springs at an acute angle to a rectangular frame. The rectangular frame has a central aperture which is substantially wider and slightly shorter than the tab. In use, a fabric is slipped between the tab and the frame. The tab is then pushed through the aperture in the frame forcing the fabric through the aperture before it. The tab is then biased by the hinge springs against the frame, securing the tag to the article of clothing.

6 Claims, 6 Drawing Figures

FABRIC IDENTIFICATION TAG

This invention pertains to a device for marking fabrics or articles of clothing and more particularly to a tag which can be easily attached to paired articles of clothing such as socks for permanent identification. Specifically, this invention pertains to a fabric sorting tag to assist in identifying difficult to identify fabric mates. More specifically, the invention pertains to a fabric color sorting tag which may be used with ease and confidence by the blind and color blind.

Marking tags and clip fasteners heretofore have been formed from die lanced sheet material. The lanced portion forms a tab free on three sides and hinged to the parent sheet material on its fourth side. The tag can be secured to a fabric by inserting a fabric between the tab and parent sheet material and then pushing the tab and the fabric through the aperture lanced in the parent sheet material. Because of the fabric's thickness, an interference fit is sometimes created. The degree of this interference fit will depend upon the actual thickness of the fabric as compared to the thickness of material the tag is designed to accommodate. Further, in order to mount a device die lanced from planar material the user must first separate the tab from the surrounding material and insert the fabric therebetween. If the tag is made from material which has the strength to provide some rigidity this spreading and insertion operation will present difficulties due to the stiffness and inelasticity of the material.

Attempts have been made in the past to meet these objections. U.S. Pat. No. 3,139,662 to Barton describes a fastener using a tab and aperture to engage fabric. The device is molded of plastic in a flat configuration. An interference fit is obtained between the tab and the aperture by profiling the edges of the tab and the aperture into interfering shapes.

While this design improves the interference fit in some respects it leaves many problems unresolved. First, the natural position of the device is flat. Thus, when the tab is on either side of the aperture very little spring force is exerted to hold the tab in contact with the aperture edges. Second, the profiled edges work to improve the interferences fit only when the edges are in alignment. Because of this, the range of thicknesses of fabrics which can be engaged by the device is limited. For instance, a device designed to engage silk fabrics cannot be secured to a thick woolen fabric. Third, the tab must be separated from the aperture and the fabric inserted into the separation when engaging the device.

U.S. Pat. No. 3,345,714 to Finkel et al supplies a positive interference fit in another manner. The Finkel device is molded of plastic. Again, the device is generally flat. In use the Finkel device is doubled over along a special groove. This results in a tab which is longer than the aperture into which it fits. The tab is also wider than the aperture in the Finkel device. Thus, positive interference is provided on three sides. Because interference is provided on three sides the Finkel device must have a narrow range of acceptable fabric thickness. A fabric which is too thick for the device will be difficult, if not impossible, to force through the aperture. In order for this device to be doubled over, a groove is formed across the breadth of the clip. This groove results in the device being substantially thinner at its point of highest deformation. The clip is also slotted along this groove to allow passage of a strap. The groove portion which acts as a hinge exists only on the two outward edges of the device. Thus, the edge where the device is doubled over is not only the thinnest portion of the device but is also slotted, wherein failure is likely to occur.

The present invention contemplates a new and improved device which overcomes these problems and others and provides a tag which is simple to use and economical to manufacture.

In accordance with the present invention a tag frame is provided to which a tab is secured at an acute angle thereto. This angulation of the tab permits it to be made longer than the tag frame aperture into which it will fit while at the same time pre-setting the precise amount of spring force desired to be exerted by the tab against the tag frame when abutting there against.

The principle object of the invention is to provide a tag device which is inexpensive to manufacture, easy to use and capable of carrying easily readable and/or touch detectable markings.

A further object of the invention is to provide a permanent identification device or marker that can be easily attached and firmly affixed to a fabric, with no deleterious effect to the wearer or the fabric and which will withstand the wear and tear of repeated washing and drying.

It is a further object of this invention to provide a method and apparatus for manufacturing and distributing groups of easily useable tags for marking fabrics in general and socks in particular.

Other objects, features and advantages of the present invention will become more apparent in light of the following detailed description of the preferred embodiment as illustrated in the accompanying drawings.

Figure 1:
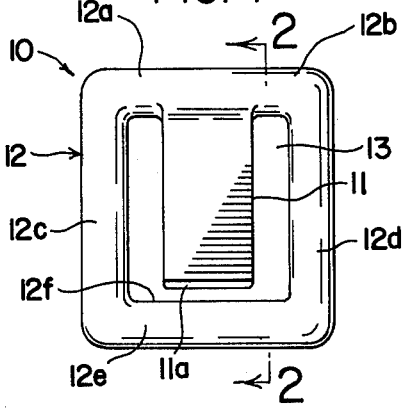
FIG. 1 is a plan view of a preferred embodiment of the invention.
Figure 2:
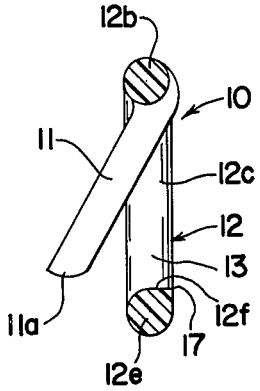
FIG. 2 is a sectional view taken along line 2—2 of FIG. 1.
Figure 3:
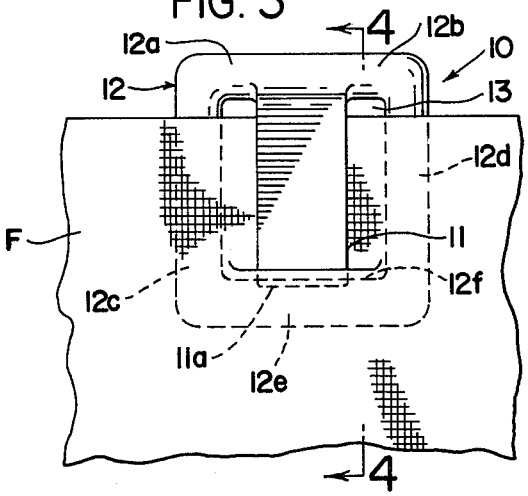
FIG. 3 is a plan view of the preferred embodiment of the invention engaged to a fabric.
Figure 4:
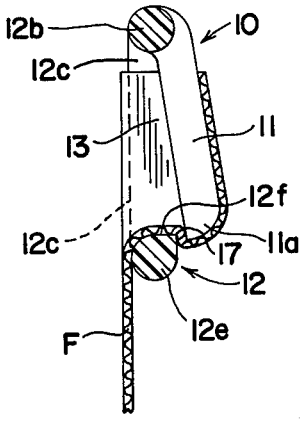
FIG. 4 is a sectional view taken along line 4—4 of FIG. 3.

Referring now to the drawings in greater detail, and in particular to FIGS. 1 and 2, the tag 10 is formed of a plastic, preferably by injection molding. A tab 11 is molded at an acute angle to a tag frame 12. The tag frame 12, which defines a rectangular aperture 13, is formed of torsional spring members 12*a* and 12*b*, side members 12*c* and 12*d* and an engagement cross member 12*e*. One end of the tab 11 is attached to the torsional spring members 12*a* and 12*b* which act as hinges allowing the tab 11 to pivot from its molded position, through the aperture 13 into its spring biased engaged position against cross member 12*e*, as shown in FIGS. 3 and 4.

The width of rectangular tab 11 is substantially less than the width of aperture 13 formed by the frame 12. This provides for two ample spaces through which a fabric F can pass when the tab 11 is in the engaged position with cross member 12*e*. Torsional spring members 12*a* and 12L*b* will twist to provide a spring force which will hold the tab 11 in pressure contact against the fabric in contact with cross member 12*e*. As best shown in FIG. 4, the lower end 11*a* of tab 11 overlaps the top edge 12*f* of cross member 12*e*.

In the preferred embodiment of the invention, the tab end 11*a* is beveled to assist in shifting tab 11 through aperture 13. Cross member 12*e* is formed to present a sharp corner 17 at the line of engagement with tab 11 to minimize slippage between the fabric F and cross member 12*e*. All other edges of the frame 12 are rounded to prevent snagging of fabrics by the tag.

Figure 5:
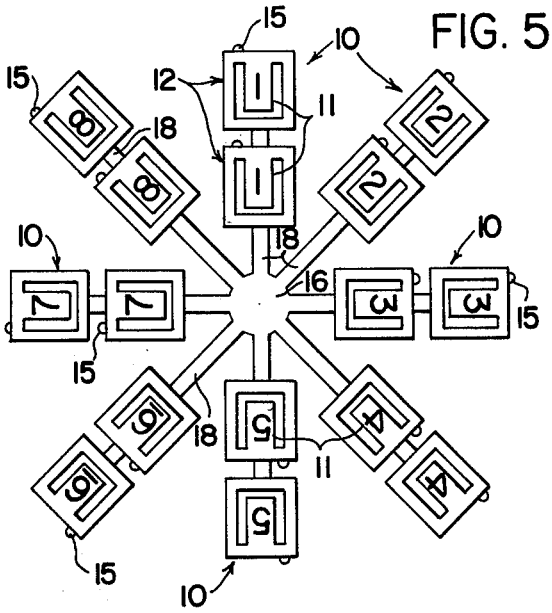
FIG. 5 is a plan view of a cluster of several pairs of the preferred embodiment of the invention; and, FIG. 6 is a plan view of an embodiment of the invention showing an alternate method of interconnecting a number of pairs of marking tags.
Figure 6:
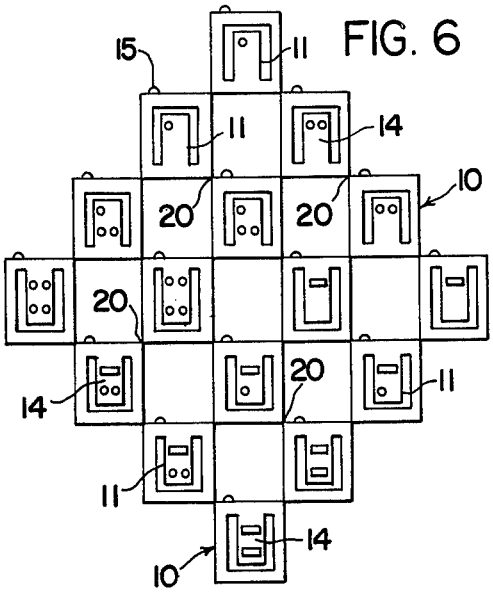

In order to minimize the cost of injection molding tags 10, it is desirable to form a number of tags at the same time. This may be accomplished by forming the tags in clusters such as shown in FIGS. 5 and 6. Moreover, these clusters make these small tags easier to handle and to merchandise. Each cluster of tags may be injection molded with colored plastic material to provide sets of tags of like color for visual identification.

As can be seen in FIGS. 5 and 6, the tags may also be marked in pairs. As shown in FIG. 5 each cluster contains eight pairs of tags interconnected on a spider 16 having breakaway legs 18. The tags 10 have raised numbers molded on the tabs 11. This provides a means of marking eight separate pairs of socks or the like with tags of the same color but with different numbers. After washing socks, for instance, they can first be sorted by the color of the tag and then sorted again by tag numbers. To assist the color blind in identifying cluster groups of tags, group symbols 15 may be molded on the frames 12 of tags 10 to correspond with a particular colored plastic.

Difficult as it is for persons with normal color perception to identify subtle differences in colored fabrics, it is, of course, impossible for the blind or the color blind to make such colored fabric distinctions. To assist the blind, in particular, FIG. 6 shows a cluster of tags of a different configuration and a second method of differentiating the tags for use by the blind. The tags 10 are interconnected at their corners 20. The interconnection is easily broken apart by flexing the tags. The tab 11 on each tag is marked with raised, braille-like symbols 14 for touch identification. Touch identification group tag symbols 15 may also be molded on the frame of each tag. The number, shape and size of these raised group tag symbols 15 may be varied from cluster to cluster as an indicia of groups for those who cannot see or identify tag colors. By placing the raised symbols on the tabs 11 and on the top of frames 12, the symbols are in exposed detectable positions when the tags are fastened on fabrics. Obviously, the blind will be able to color sort fabrics identified with the tags 10 of either FIG. 5 or 6 by touch, whereas those of normal vision and the color blind will be able to color sort fabrics by visual inspection of these same color matching symbols.

The invention has been described with reference to the preferred embodiments. Obviously modifications and alterations will occur to those skilled in the art upon the reading and understanding of this specification. It is my intention to include all such modifications and alterations insofar as they come within the scope of the appended claims or the equivalent thereof.

Having thus described my invention, I claim:

1. A permanent fabric marking device comprising: an injection molded tag of resilient water resistant plastic including a body having top, bottom and side portions defining a central aperture; a tab molded to said top portion at an angle to the plane of said body having a width less than said aperture and a length greater than said aperture, being centered between said side portions and biasable through said central aperture by flexing; the free end of said tab being beveled on the inside edge to assist in biasing over said bottom portion; the outside edge of the free end of said tab and the outside edge of said bottom portion being opposed and wedge shaped to grip a fabric therebetween; wherein biasing said tab from its position on one side of said body to a fabric gripping position on the other side of said body places said top portion of said body in torsion to urge said free end of said tab in pressure engaging contact against fabric sandwiched between said wedge shaped edges of said bottom portion and said free end of said tab.

2. The device of claim 1, wherein pairs of tags are distinctively match coded to distinguish one pair of tags from another pair of tags.

3. The device of claim 1, wherein pairs of tags are both match coded and color coded to distinguish one pair of tags from another pair of tags and to distinguish the color of the fabric in one pair of tags from the color of the fabric in another pair of tags.

4. The device of claim 1, wherein pairs of tags are distinctively match coded by braille-like indicia to distinguish one pair of tags from another pair of tags.

5. The device of claim 1, wherein pairs of tags are both match coded and color coded by braille-like indicia to distinguish one pair of tags from another pair of tags and to distinguish the color of the fabric in one pair of tags from the color of the fabric in another pair of tags.

6. The device of claim 1, wherein all portions of said body are rounded to prevent snagging except said wedge shaped gripping portions of said tag.

* * * * *